US010890188B2

(12) United States Patent
Rockwood et al.

(10) Patent No.: US 10,890,188 B2
(45) Date of Patent: Jan. 12, 2021

(54) COMPRESSOR NOISE REDUCTION

(71) Applicant: TRANE INTERNATIONAL INC., Davidson, NC (US)

(72) Inventors: William B. Rockwood, Mindoro, WI (US); Richard D. Harmening, La Crosse, WI (US); Todd Kearney, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 319 days.

(21) Appl. No.: 15/682,208

(22) Filed: Aug. 21, 2017

(65) Prior Publication Data

US 2018/0051698 A1 Feb. 22, 2018

Related U.S. Application Data

(60) Provisional application No. 62/377,734, filed on Aug. 22, 2016.

(51) Int. Cl.

| | |
|---|---|
| ***F04C 29/06*** | (2006.01) |
| ***F04C 18/02*** | (2006.01) |
| ***F04C 29/12*** | (2006.01) |
| ***F25B 1/04*** | (2006.01) |
| ***F04C 29/00*** | (2006.01) |
| ***F04C 23/00*** | (2006.01) |

(52) U.S. Cl.

CPC ..... *F04C 29/063* (2013.01); *F04C 18/0215* (2013.01); *F04C 23/008* (2013.01); *F04C 29/0035* (2013.01); *F04C 29/065* (2013.01); *F04C 29/12* (2013.01); *F25B 1/04* (2013.01); *F04C 2240/30* (2013.01); *F25B 2500/12* (2013.01)

(58) Field of Classification Search

CPC .. F04C 29/063; F04C 18/0215; F04C 29/065; F04C 29/12; F04C 2240/30; F25B 2500/12; F25B 1/04; F04D 29/663; F04D 29/664

USPC ..... 417/312

See application file for complete search history.

(56) References Cited

U.S. PATENT DOCUMENTS

| | | | |
|---|---|---|---|
| 3,448,918 | A | 6/1969 | Cawley |
| 3,462,075 | A | 8/1969 | Dirk et al. |
| 4,487,555 | A | 12/1984 | Ohinata et al. |
| 4,544,334 | A | 10/1985 | Ellis |
| 4,696,630 | A | 9/1987 | Sakata et al. |
| 5,487,654 | A | 1/1996 | Wallis et al. |

(Continued)

FOREIGN PATENT DOCUMENTS

| | | |
|---|---|---|
| JP | S58170877 | 10/1983 |
| JP | S60-145483 | 7/1985 |

(Continued)

*Primary Examiner* — Connor J Tremarche

(74) *Attorney, Agent, or Firm* — Hamre, Schumann, Mueller & Larson, P.C.

(57) ABSTRACT

A scroll compressor is disclosed. The compressor includes an enclosure including a compression mechanism that compresses a working fluid. A discharge port discharges a compressed working fluid. A discharge plenum receives the compressed working fluid from the discharge port. A pulsation absorber is disposed within the discharge plenum, the pulsation absorber dividing the discharge plenum into a plurality of volumes.

20 Claims, 5 Drawing Sheets

(56) References Cited

U.S. PATENT DOCUMENTS

| | | | | |
|---|---|---|---|---|
| 5,582,511 | A * | 12/1996 | Fairbanks | F04C 18/0215 29/888.022 |
| 5,649,816 | A | 7/1997 | Wallis et al. | |
| 5,667,371 | A | 9/1997 | Prenger et al. | |
| 5,829,960 | A | 11/1998 | Dreiman | |
| 5,921,761 | A | 7/1999 | Eckels | |
| 5,980,222 | A | 11/1999 | Fry | |
| 6,217,302 | B1 | 4/2001 | Sun et al. | |
| 6,287,089 | B1 | 9/2001 | Williams et al. | |
| 6,422,842 | B2 | 7/2002 | Sheridan et al. | |
| 6,428,293 | B1 | 8/2002 | Dewar et al. | |
| 6,820,431 | B2 | 11/2004 | McManus et al. | |
| 7,156,624 | B2 | 1/2007 | Shoulders | |
| 7,195,468 | B2 | 3/2007 | Um | |
| 7,398,855 | B2 | 7/2008 | Seel | |
| 7,744,357 | B2 | 6/2010 | Kim et al. | |
| 8,480,350 | B2 | 7/2013 | Winter | |
| 8,496,446 | B2 * | 7/2013 | Lai | F04C 18/0215 181/264 |
| 8,591,208 | B2 | 11/2013 | Broerman, III et al. | |
| 2006/0065478 | A1 | 3/2006 | Rockwell | |
| 2008/0008612 | A1 | 1/2008 | Kim et al. | |
| 2010/0034634 | A1 * | 2/2010 | Scarinci | F04D 29/444 415/1 |
| 2010/0122549 | A1 * | 5/2010 | Cho | F01C 21/007 62/469 |
| 2011/0318166 | A1 * | 12/2011 | Schuller | F04B 11/00 415/119 |
| 2014/0271242 | A1 | 9/2014 | Calhoun et al. | |
| 2016/0017885 | A1 | 1/2016 | Al-Hasan et al. | |

FOREIGN PATENT DOCUMENTS

| | | |
|---|---|---|
| JP | S6140473 | 2/1986 |
| JP | H01170781 | 7/1989 |

* cited by examiner

COMPRESSOR NOISE REDUCTION

FIELD

This disclosure relates generally to a vapor compression system. More specifically, this disclosure relates to sound level control in a compressor of a vapor compression system such as, but not limited to, compressor in a heating, ventilation, and air conditioning (HVAC) system.

BACKGROUND

One type of compressor for a vapor compression system is generally referred to as a scroll compressor. Scroll compressors generally include a pair of scroll members which orbit relative to each other to compress a working fluid such as, but not limited to, air or a refrigerant. A typical scroll compressor includes a first, stationary scroll member having a base and a generally spiral wrap extending from the base, and a second, orbiting scroll member having a base and a generally spiral wrap extending from the base. The spiral wraps of the first and second orbiting scroll members are interleaved, creating a series of compression chambers. The second, orbiting scroll member is driven to orbit the first, stationary scroll member by rotating a shaft. Some scroll compressors employ an eccentric pin on the rotating shaft that drives the second, orbiting scroll member.

SUMMARY

This disclosure relates generally to a vapor compression system. More specifically, this disclosure relates to sound level control in a compressor of a vapor compression system such as, but not limited to, compressor in a heating, ventilation, and air conditioning (HVAC) system.

A scroll compressor is disclosed. The compressor includes an enclosure including a compression mechanism that compresses a working fluid. A discharge port discharges a compressed working fluid. A discharge plenum receives the compressed working fluid from the discharge port. A pulsation absorber is disposed within the discharge plenum, the pulsation absorber dividing the discharge plenum into a plurality of volumes.

A heating, ventilation, and air conditioning (HVAC) system is disclosed. The HVAC system includes a compressor, a condenser, an expansion device, and an evaporator fluidly connected to form a heat transfer circuit. The compressor is a scroll compressor that includes an enclosure including a compression mechanism that compresses a working fluid. A discharge port discharges a compressed working fluid. A discharge plenum receives the compressed working fluid from the discharge port. A pulsation absorber is disposed within the discharge plenum, the pulsation absorber dividing the discharge plenum into a plurality of volumes.

A method for attenuating pulsation in a scroll compressor is disclosed. The method includes directing a compressed working fluid from a compression mechanism of the scroll compressor through a discharge port into the discharge plenum; and directing the compressed working fluid into a plurality of volumes within the discharge plenum, the plurality of volumes being formed by a pulsation absorber disposed within the discharge plenum.

BRIEF DESCRIPTION OF THE DRAWINGS

References are made to the accompanying drawings that form a part of this disclosure and which illustrate embodiments in which the systems and methods described in this specification can be practiced.

Like reference numbers represent like parts throughout.

DETAILED DESCRIPTION

This disclosure relates generally to sound level control in a vapor compression system. More specifically, this disclosure relates to discharge pulsation absorption in a compressor of a vapor compression system such as, but not limited to, a heating, ventilation, and air conditioning (HVAC) system.

Compressors generate sound when in operation. For example, in a scroll compressor, as a working fluid is compressed and then discharged into a discharge plenum of the scroll compressor, pulsations of the compressed working fluid may, for example, reflect off one or more walls in an enclosure of the scroll compressor. The discharge pulsations can increase a sound level of the compressor. It is desirable to control a sound level of the scroll compressor so that the scroll compressor can operate at a relatively quieter sound level. In some situations, this may be required by, for example, building codes or the like, which may limit an amount of sound that, for example, a refrigeration unit, may produce. This disclosure is directed to reducing a sound level of scroll compressors by, for example, blocking transmission of discharge pulsations of the compressed working fluid.

A "sound level" includes, for example, a sound power level, a sound pressure level, or the like.

A "sound power level" includes, for example, an inherent property of a compressor. In some embodiments, a sound power level can alternatively be referred to as a sound level. For example, a compressor that produces 90 decibels (dB) of a sound power level will produce this regardless of where it is located or measured. The sound power level can be expressed in terms of dBs relative to a reference sound power:

$$L_w = 10 \log_{10}\left\{\frac{\text{sound power, W}}{10^{-12}\ \text{W}}\right\}$$

where "$L_w$" is the sound power level, and "sound power, W" and "$10^{-12}$ W" are the sound powers. Note that the "sound power level" and the "sound power" are different. The former is a quantity expressed in terms of dBs, while the latter is a quantity expressed in terms of watts.

A "sound pressure level" includes, for example, a sound property that is dependent on a location of the measurement relative to the compressor. For example, a compressor will be louder if the measurement is taken from about one meter away than if the measurement is taken from about five meters away. A sound pressure level can be expressed in terms of dBs relative to a reference sound pressure:

$$L_P = 20 \log_{10}\left\{\frac{\text{sound pressure, } \mu\text{Pa}}{20\ \mu\text{Pa}}\right\}$$

where "$L_p$" is the sound pressure level, and "sound pressure, μPa" and "20 μPa" are the sound pressures. Note that the "sound pressure level" and "sound pressure" are different. The former is a quantity expressed in terms of dBs, while the latter is a quantity expressed in terms of Pascals.

Figure 1:
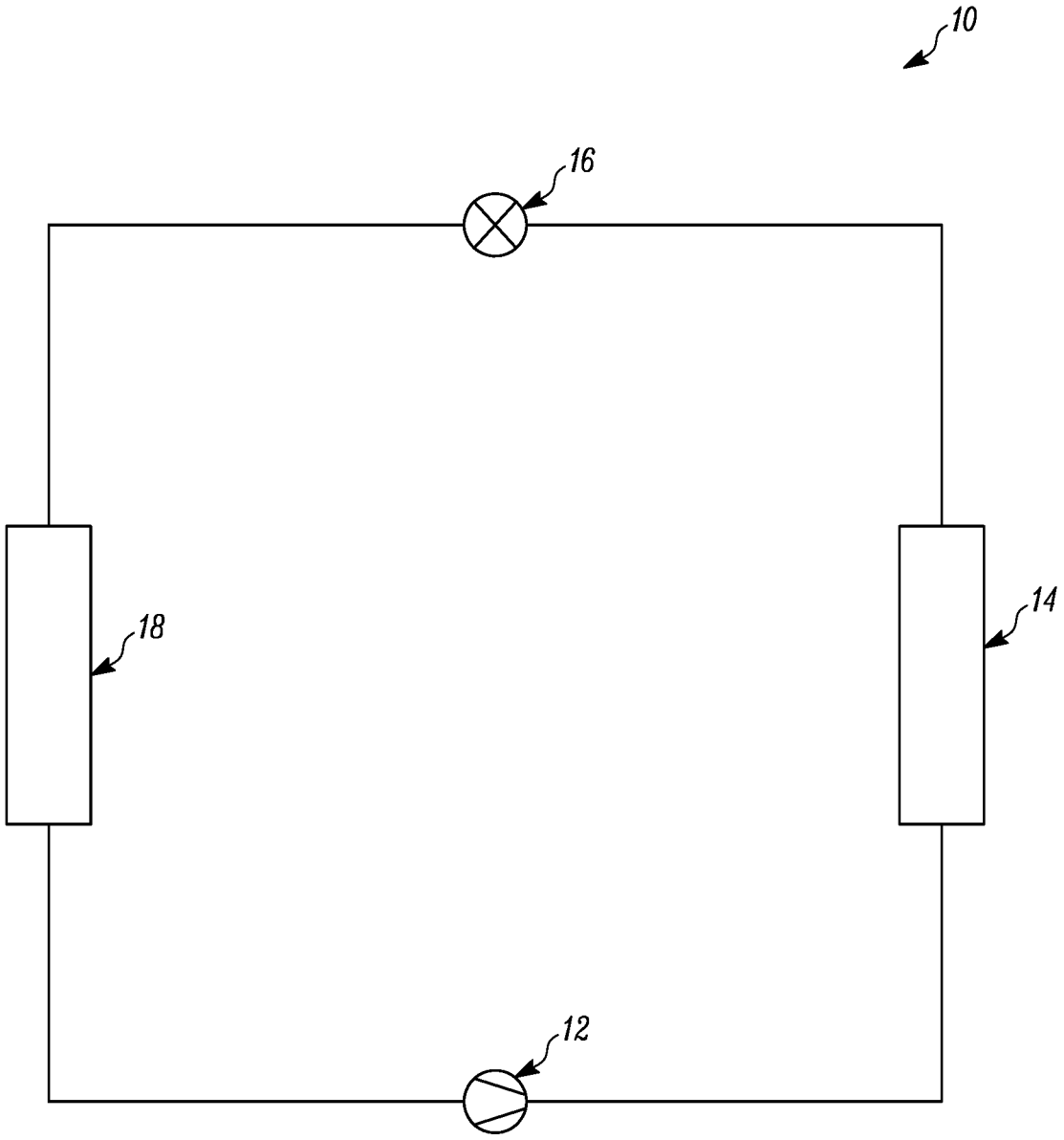
FIG. 1 is a schematic diagram of a heat transfer circuit, according to an embodiment.

FIG. 1 is a schematic diagram of a heat transfer circuit 10, according to an embodiment. In an embodiment, the heat transfer circuit 10 can alternatively be referred to as the refrigerant circuit 10 or the like. The heat transfer circuit 10 generally includes a compressor 12, a condenser 14, an expansion device 16, and an evaporator 18. The compressor 12 can be, for example, a scroll compressor such as the scroll compressor shown and described in accordance with FIG. 2 below. The heat transfer circuit 10 is an example and can be modified to include additional components. For example, in an embodiment, the heat transfer circuit 10 can include other components such as, but not limited to, an economizer heat exchanger, one or more flow control devices, a receiver tank, a dryer, a suction-liquid heat exchanger, or the like.

The heat transfer circuit 10 can generally be applied in a variety of systems used to control an environmental condition (e.g., temperature, humidity, air quality, or the like) in a space (generally referred to as a conditioned space). Examples of such systems include, but are not limited to, HVAC systems, transport refrigeration systems, or the like.

The compressor 12, condenser 14, expansion device 16, and evaporator 18 are fluidly connected. In an embodiment, the heat transfer circuit 10 can be configured to be a cooling system (e.g., an air conditioning system) capable of operating in a cooling mode. In an embodiment, the heat transfer circuit 10 can be configured to be a heat pump system that can operate in both a cooling mode and a heating/defrost mode.

The heat transfer circuit 10 can operate according to generally known principles. The heat transfer circuit 10 can be configured to heat or cool a liquid process fluid (e.g., a heat transfer fluid or medium (e.g., a liquid such as, but not limited to, water or the like)), in which case the heat transfer circuit 10 may be generally representative of a liquid chiller system. The heat transfer circuit 10 can alternatively be configured to heat or cool a gaseous process fluid (e.g., a heat transfer medium or fluid (e.g., a gas such as, but not limited to, air or the like)), in which case the heat transfer circuit 10 may be generally representative of an air conditioner or heat pump.

In operation, the compressor 12 compresses a working fluid (e.g., a heat transfer fluid (e.g., refrigerant or the like)) from a relatively lower pressure gas to a relatively higher-pressure gas. The relatively higher-pressure gas is also at a relatively higher temperature, which is discharged from the compressor 12 and flows through the condenser 14. In accordance with generally known principles, the working fluid flows through the condenser 10 and rejects heat to the process fluid (e.g., water, air, etc.), thereby cooling the working fluid. The cooled working fluid, which is now in a liquid form, flows to the expansion device 16. The expansion device 16 reduces the pressure of the working fluid. As a result, a portion of the working fluid is converted to a gaseous form. The working fluid, which is now in a mixed liquid and gaseous form flows to the evaporator 18. The working fluid flows through the evaporator 18 and absorbs heat from the process fluid (e.g., a heat transfer medium (e.g., water, air, etc.)), heating the working fluid, and converting it to a gaseous form. The gaseous working fluid then returns to the compressor 12. The above-described process continues while the heat transfer circuit is operating, for example, in a cooling mode (e.g., while the compressor 12 is enabled).

Figure 2:
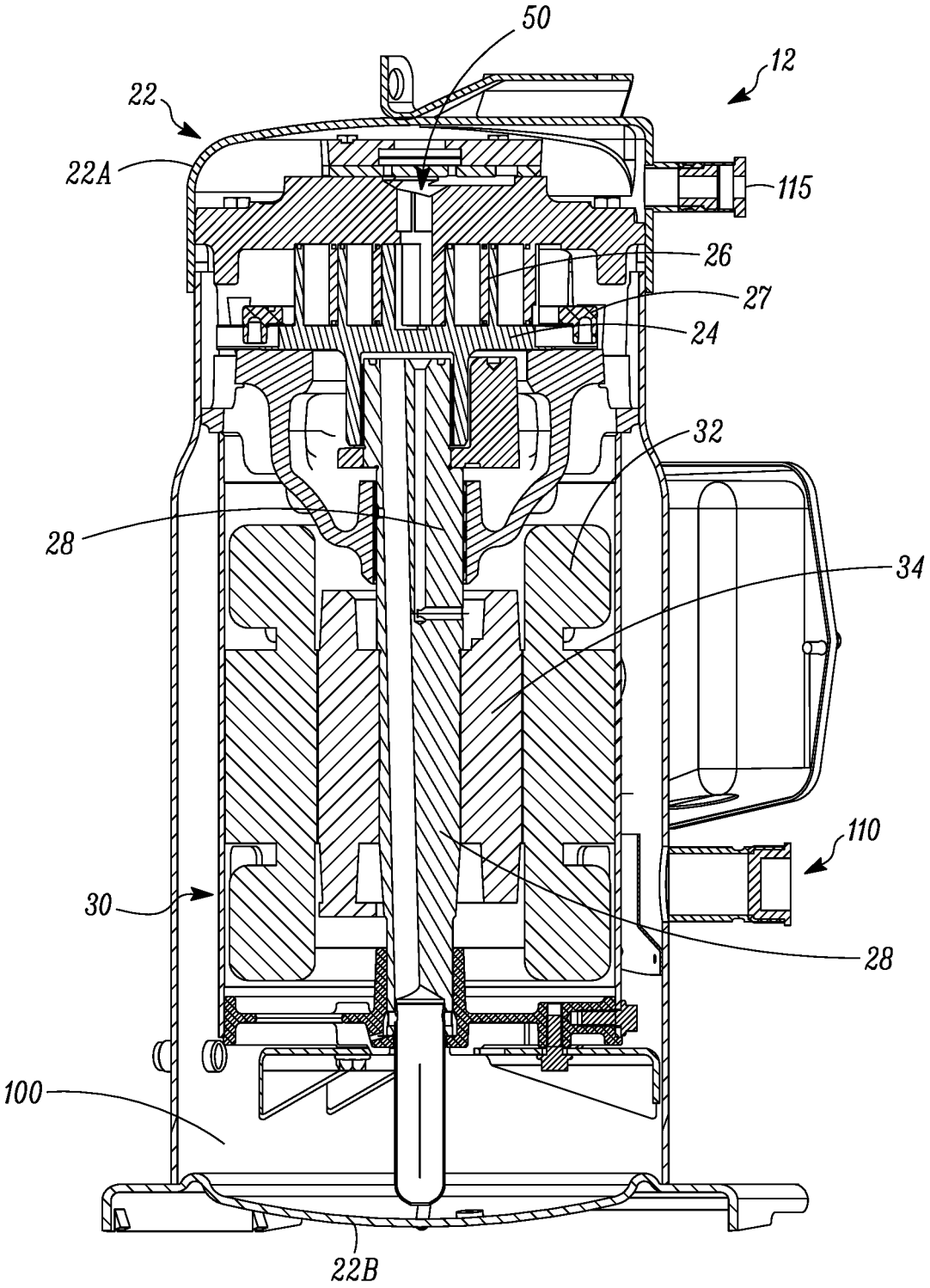
FIG. 2 is a sectional view of a compressor with which embodiments disclosed in this specification can be practiced, according to an embodiment.

FIG. 2 illustrates a sectional view of the compressor 12 with which embodiments as disclosed in this specification can be practiced, according to an embodiment. The compressor 12 can be used in the heat transfer circuit 10 of FIG. 1. It is to be appreciated that the compressor 12 can also be used for purposes other than in a heat transfer circuit. For example, the compressor 12 can be used to compress air or gases other than a heat transfer fluid (e.g., natural gas, etc.). It is to be appreciated that the compressor 12 can include additional features that are not described in detail in this specification. For example, the compressor 12 includes a lubricant sump 100 for storing lubricant to be introduced to the moving features of the compressor 12.

The illustrated compressor 12 is a single-stage scroll compressor. More specifically, the illustrated compressor 12 is a single-stage vertical scroll compressor. It is to be appreciated that the principles described in this specification are not intended to be limited to single-stage scroll compressors and that they can be applied to multi-stage scroll compressors having two or more compression stages. Generally, the embodiments as disclosed in this specification are illustrated with a compressor with a vertical or a near vertical crankshaft (e.g., crankshaft 28). It is to be appreciated that the embodiments may also be applied to a horizontal compressor.

The compressor 12 is illustrated in sectional side view. The compressor 12 includes an enclosure 22. The enclosure 22 includes an upper portion 22A and a lower portion 22B. In operation, the upper portion 22A is at or about a discharge pressure and the lower portion 22B is at or about a suction pressure. The compressor 12 includes a suction inlet 110 and a discharge outlet 115.

The compressor 12 includes an orbiting scroll 24 and a non-orbiting scroll 26. The non-orbiting scroll 26 can alternatively be referred to as, for example, the stationary scroll 26, the fixed scroll 26, or the like. The non-orbiting scroll 26 is aligned in meshing engagement with the orbiting scroll 24 by means of an Oldham coupling 27. The orbiting scroll 24 and the non-orbiting scroll 26 may selectively be referred to as a compression mechanism that compresses a working fluid (e.g., heat transfer fluid such as refrigerant or the like, etc.). The compressed working fluid is provided to the discharge outlet 115 via a discharge port 50.

The compressor 12 includes a driveshaft 28. The driveshaft 28 can alternatively be referred to as the crankshaft 28. The driveshaft 28 can be rotatably driven by, for example, an electric motor 30. The electric motor 30 can generally include a stator 32 and a rotor 34. The driveshaft 28 is fixed to the rotor 34 such that the driveshaft 28 rotates along with the rotation of the rotor 34. The electric motor 30, stator 32, and rotor 34 can operate according to generally known principles. The driveshaft 28 can, for example, be fixed to the rotor 34 via an interference fit or the like. The driveshaft 28 can, in an embodiment, be connected to an external electric motor, an internal combustion engine (e.g., a diesel engine or a gasoline engine), or the like. It will be appreciated that in such embodiments the electric motor 30, stator 32, and rotor 34 would not be present in the compressor 12.

Figure 3:
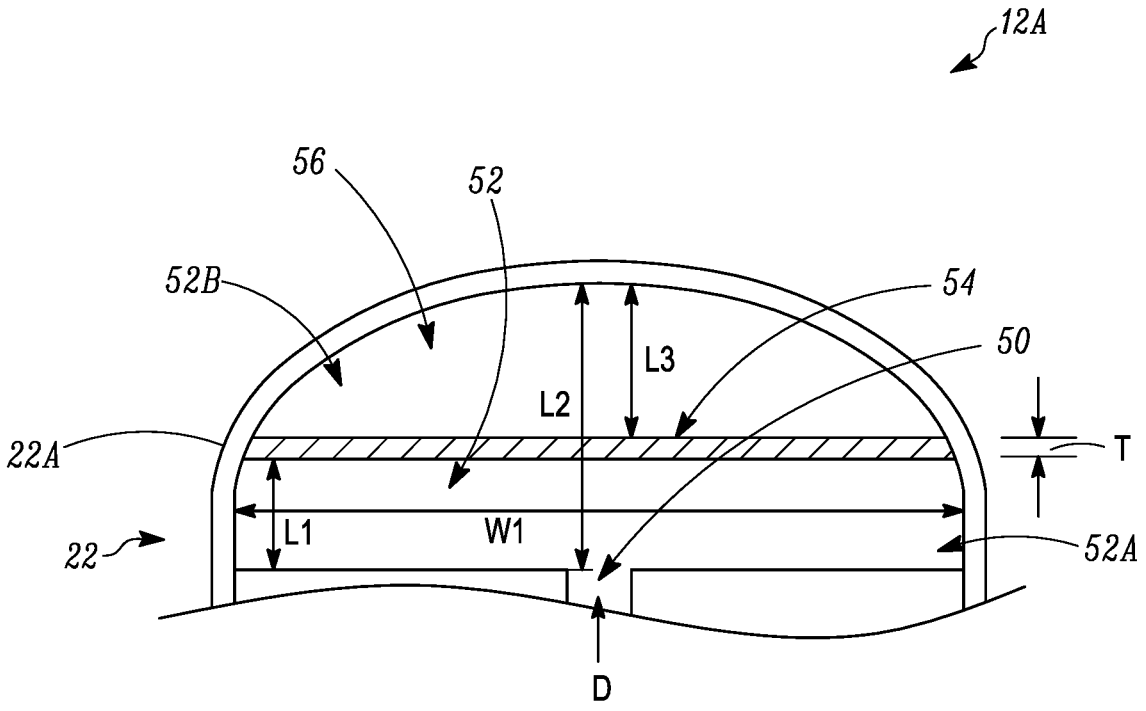
FIG. 3 is a sectional view of a portion of a compressor, according to an embodiment.

FIG. 3 illustrates a sectional view of the upper portion 22A of a compressor 12A, according to an embodiment. The compressor 12A can be used in the heat transfer circuit 10 of FIG. 1. It is to be appreciated that the compressor 12A can also be used for purposes other than in a heat transfer circuit. For example, the compressor 12A can be used to compress air or gases other than a heat transfer fluid (e.g., natural gas, etc.). It is to be appreciated that the compressor 12A can include additional features that are not described in detail in this specification. The compressor 12A can include aspects that are the same as or similar to the compressor 12 as shown and described in accordance with FIG. 2 above.

The compressor 12A includes a discharge port 50, a discharge plenum 52, a pulsation absorber 54, and a pulsation chamber 56 disposed in the upper portion 22A of the enclosure 22.

In operation, a compression mechanism (e.g., orbiting scroll 24 and non-orbiting scroll 26 in FIG. 2) compresses a working fluid (e.g., heat transfer fluid such as refrigerant or the like, etc.). The compressed working fluid is provided in a direction D from the discharge port 50. The compression mechanism and discharge port 50 can function according to known principles to provide the working fluid at a relatively high pressure. The compressed working fluid enters the discharge plenum 52. The compressed working fluid can interact with the pulsation absorber 54. The pulsation absorber 54 can absorb sound via friction in one or more passages in the pulsation absorber 54 and associated heating of the working fluid, disperse the working fluid, and/or reduce pulsations of the working fluid in the discharge plenum 52. The one or more passages in the pulsation absorber 54 can be, for example, viewable under magnification such as, via a microscope. The pulsation absorber 54 can be, for example, a porous member disposed within the discharge plenum 52, thereby dividing the discharge plenum into a first portion 52A and a second portion 52B. The second portion 52B of the discharge plenum forms the pulsation chamber 56. In an embodiment, the pulsation absorber 54 can be, for example, composed of a sintered metal, a perforated sheet metal, a micro-perforated sheet metal, metallic fibers, other materials suitable for absorbing and/or blocking pulsation levels in the working fluid, or the like.

The pulsation absorber 54 has a thickness T. The thickness T can be selected to achieve a desired pulsation reduction based on properties (e.g., porosity, acoustic properties, stiffness, etc.) of a material selected for the pulsation absorber 54 and a frequency range to attenuate. In an embodiment, the pulsation absorber is disposed a distance L1 from the discharge port 50. In an embodiment, the distance L1 can be selected to provide an optimal effectiveness (e.g., a relatively largest amount of sound level reduction) of the pulsation absorber 54. In an embodiment, the distance L1 can be selected based on, for example, optimizing pulsation reduction across a particular frequency range. The discharge plenum 52, including the first and second portions 52A, 52B, extends a distance L2 from the discharge port 50 to an inner surface of the upper portion 22A of the enclosure 22. A distance from an upper surface of the pulsation absorber 54 to the inner surface of the upper portion 22A of the enclosure 22 is represented as L3. Accordingly, the distance L1 plus the distance L3 and the thickness T of the pulsation absorber 54 is equivalent to the distance L2. The distances L1, L2, L3, and the thickness T are selected in combination to determine an absorption effectiveness of the pulsation absorber 54. A combination of L1, L2, and L3 can be selected, for example, based on operating parameters (e.g., operating speed and frequency range, etc.) of the compressor 12.

In an embodiment, the pulsation absorber 54 can be included in the upper portion 22A of the enclosure 22 of the compressor 12A at a time of manufacturing the enclosure 22. In an embodiment, the pulsation absorber 54 can be installed into the enclosure 22 of the compressor 12A at a time after manufacturing, including after the compressor 12A has been operated. That is, the pulsation absorber 54 can be retrofit into the compressor 12A, according to an embodiment.

In an embodiment, the pulsation absorber 54 can absorb pressure pulsations of the compressed working fluid from the discharge port 50. In an embodiment, the absorption of the pressure pulsations can, for example, reduce an overall sound level of the compressor 12A. Accordingly, in an embodiment, the compressor 12A having the pulsation absorber 54 may operate relatively quieter than a compressor that does not include the pulsation absorber 54.

Figure 4:
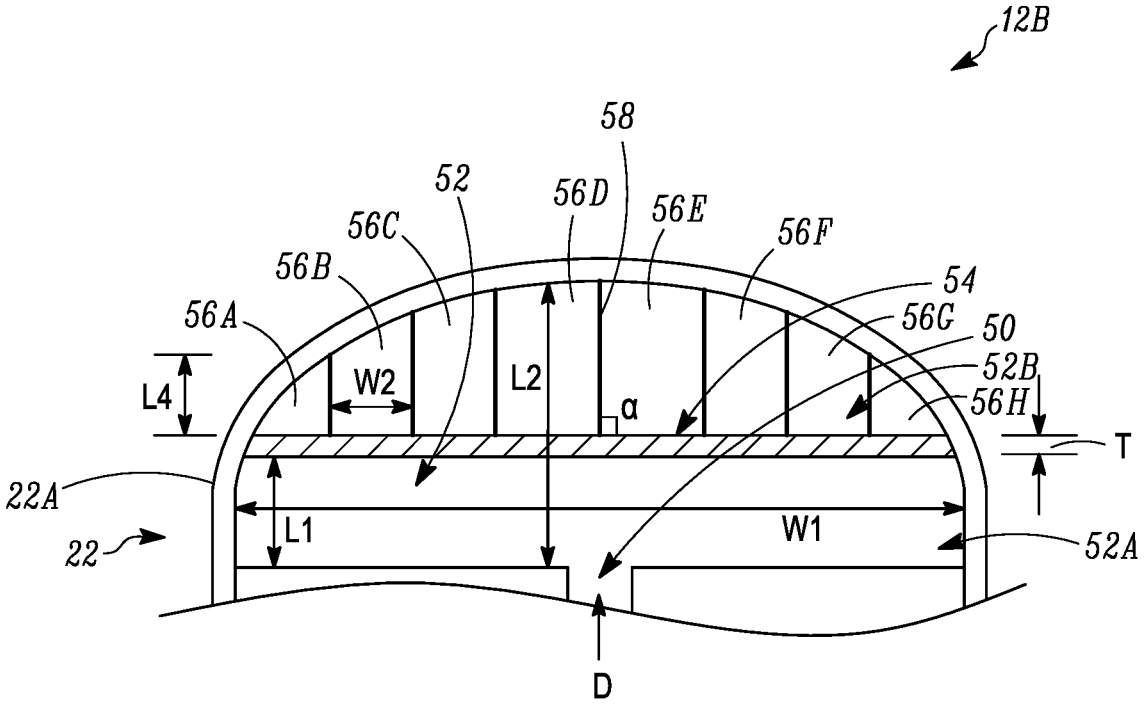
FIG. 4 is a sectional view of a portion of a compressor, according to an embodiment.

FIG. 4 illustrates a sectional view of a portion of a compressor 12B, according to an embodiment. The compressor 12B can be used in the heat transfer circuit 10 of FIG. 1. It is to be appreciated that the compressor 12B can also be used for purposes other than in a heat transfer circuit. For example, the compressor 12B can be used to compress air or gases other than a heat transfer fluid (e.g., natural gas, etc.). It is to be appreciated that the compressor 12B can include additional features that are not described in detail in this specification. The compressor 12B can include aspects that are the same as or similar to the compressors 12 and 12A as shown and described in accordance with FIGS. 2 and 3 (respectively) above.

The compressor 12B, in addition to the aspects shown and described in accordance with FIG. 3 above, includes a plurality of tuning members 58 disposed within the pulsation chamber 56. The plurality of tuning members 58 divides the pulsation chamber 56 into a plurality of separate pulsation chambers 56A-56H. It will be appreciated that the number of tuning members 58 and accordingly, the number of pulsation chambers 56A-56H, can vary. For example, in the illustrated embodiment, eight pulsation chambers 56A-56H are shown. The number can be increased or decreased. For example, the embodiment of FIG. 3 includes a single pulsation chamber 56. Alternatively, the number of pulsation chambers can be increased as well. The number and size of the pulsation chambers 56A-56H can be determined based on a plurality of factors. For example, the number of pulsation chambers 56A-56H can generally be selected to tune frequencies across a wide range of operating conditions for the compressor 12B. In an embodiment, the number of pulsation chambers 56A-56H can be limited by, for example, a size of the compressor 12B, manufacturing limitations, or the like.

The tuning members 58 extend between the pulsation absorber 54 and an inner surface of the upper portion 22A of the enclosure 22. The tuning members 58 generally extend at an angle $\alpha$ that is at or about 90° with respect to a surface of the pulsation absorber that is within the pulsation chamber 52B. As a result, the tuning members 58 may generally extend in a direction that is parallel to a longitudinal axis of the compressor 12B. The tuning members 58 extend a distance L4 between the pulsation absorber 54 and the upper portion 22A of the enclosure 22 of the compressor 12B. As illustrated in FIG. 4, the distance L4 can vary depending upon a location of the tuning member 58 along a width W1. It will be appreciated that the width W1 can be representative of a diameter of the upper portion 22A enclosure 22 of the compressor 12B. A distance W2 is defined between the tuning members 58 in a direction along the distance W1. The distance W1 is greater than the distance W2. The distance W2 can be varied to create pulsation chambers 56A-56H having varied volumes. Varying the volumes can, for example, tune frequencies at which the pulsation chambers 56A-56H may be effective. In the illustrated embodiment, the tuning members 58 extend from the pulsation absorber 54 to the upper portion 22A of the enclosure 22. It will be appreciated that one or more of the tuning members 58 may extend from the pulsation absorber 54 and terminate prior to the upper portion 22A of the enclosure 22. In an embodiment, the tuning members may be relatively flexible.

In an embodiment, the pulsation absorber 54 and pulsation chambers 56A-56H can be included in the upper portion 22A of the enclosure 22 of the compressor 12B at a time of manufacturing the enclosure 22. In an embodiment, the pulsation absorber 54 and pulsation chambers 56A-56H can be installed into the enclosure 22 of the compressor 12B at a time after manufacturing, including after the compressor 12B has been operated. That is, the pulsation absorber 54 and pulsation chambers 56A-56H can be retrofit into the compressor 12B, according to an embodiment.

In an embodiment, the pulsation absorber 54 and pulsation chambers 56A-56H can absorb pressure pulsations of the compressed working fluid from the discharge port 50. In an embodiment, the absorption of the pressure pulsations can, for example, reduce an overall sound level of the compressor 12B. Accordingly, in an embodiment, the compressor 12B having the pulsation absorber 54 and the pulsation chambers 56A-56H may operate relatively quieter than a compressor that does not include the pulsation absorber 54 or the pulsation chambers 56A-56H. In an embodiment, the compressor 12B may operate relatively quieter than the compressor 12A in FIG. 3.

Figure 5:
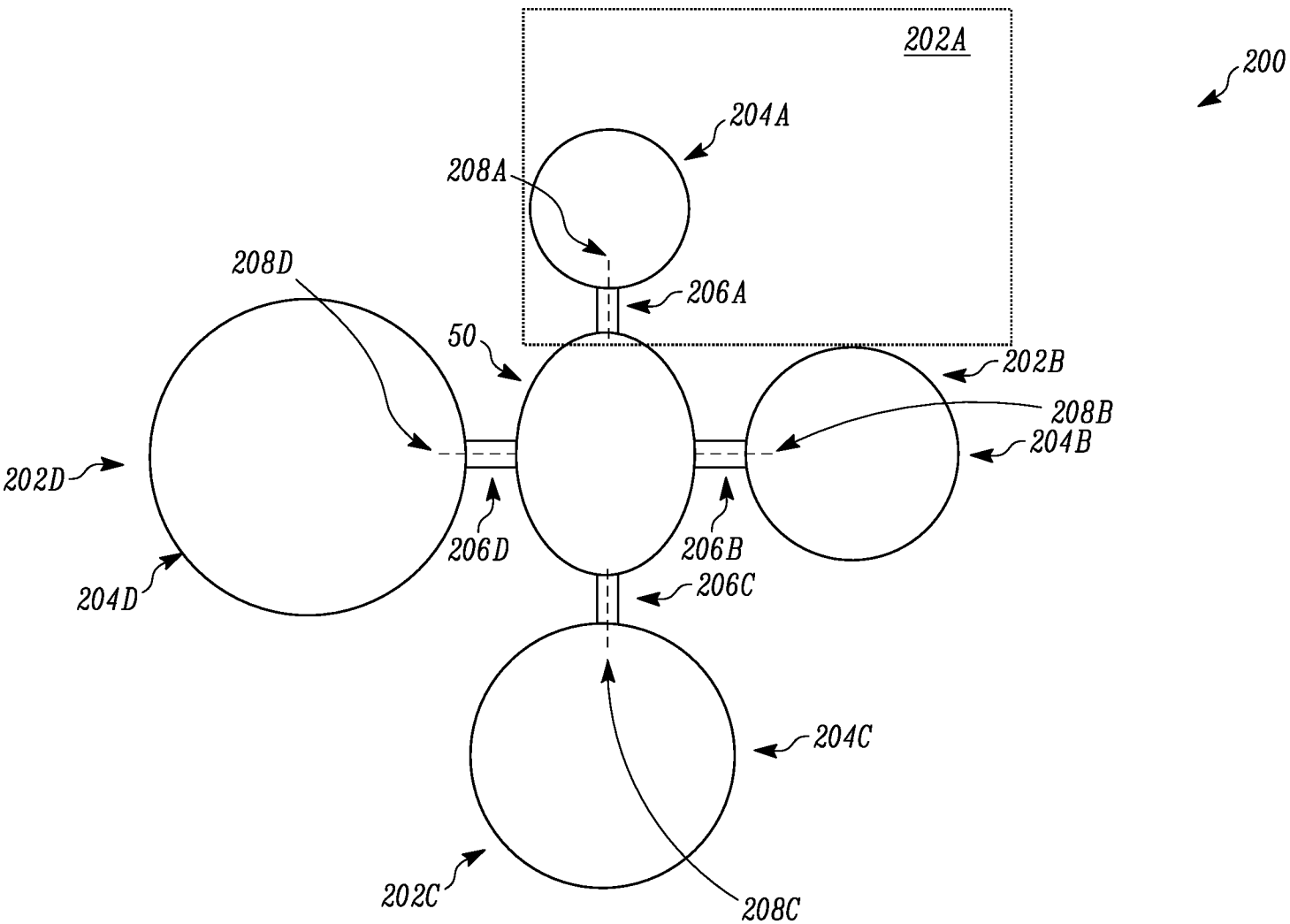
FIG. 5 is a schematic diagram of muffler assembly for a compressor, according to an embodiment.

FIG. 5 is a schematic diagram of a muffler 200 for a compressor (e.g., the compressor 12 in FIG. 2). The muffler 200 is illustrated without illustrating the remainder of the compressor 12 for simplicity of the figures and the specification. The muffler 200 is disposed within the upper portion 22A (FIG. 2) of the enclosure 22 (FIG. 2) of the compressor 12. In an embodiment, a plurality of the mufflers 200 can be included in the upper portion 22A. For example, in the compressor 12, which is a vertical compressor, a plurality of the mufflers 200 can be stacked vertically (e.g., along a longitudinal axis of the compressor 12). In such an embodiment, a first of the plurality of mufflers 200 can be disposed a first location between the discharge port 50 and the upper portion 22A of the enclosure 22, and a second of the plurality of mufflers 200 can be disposed between the first of the plurality of mufflers 200 and the upper portion 22A of the enclosure 22. Including the additional mufflers 200 can, in an embodiment, improve an effectiveness of the muffler 200 in reducing a sound level of the compressor 12. In such an embodiment, the mufflers 200 can be tuned to attenuate discharge pulsations at different frequencies, thereby expanding a range of frequencies at which the muffler 200 may be effective.

The muffler 200 includes a plurality of muffler assemblies 202A-202D. The muffler assemblies 202A-202D can alternatively be referred to as the resonators 202A-202D. In an embodiment, the muffler assemblies 202A-202D can sometimes be referred to as the Helmholtz Resonators 202A-202D. The resonators 202A-202D include a volume 204A-204D fluidly communicable with the discharge port 50 of the compressor 12 via connecting tubes 206A-206D. In an embodiment, the connecting tubes 206A-206D can be oriented such that a longitudinal axis 208A-208D of the connecting tubes 206A-206D is at or about perpendicular to the discharge port 50. Helmholtz resonators can approximate a mass on a spring, and can accordingly be mechanically defined as such. Accordingly, a Helmholtz resonator can have a mass element and an elastic element. In operation, the volumes 204A-204D serve as the elastic element of the resonator, while the compressed working fluid within the connecting tubes 206A-206D serves as the mass element. Functionally, the muffler assemblies 202A-202D serve to dampen the discharge pulsations from the compressor 12.

The volumes 204A-204D are illustrated as being generally circular. It will be appreciated that the particular geometry of the volumes 204A-204D is not limited to generally circular. In an embodiment, the volumes 204A-204D can be machined into a casting of the compressor 12.

The connecting tubes 206A-206D can be modified to tune each of the muffler assemblies 202A-202D to a different frequency. For example, modifying one or more dimensions (e.g., diameter, length, and/or thickness of walls) of the connecting tubes 206A-206D or modifying a volume of the connecting tubes 206A-206D can change the attenuating frequency of the connecting tubes 206A-206D. In an embodiment, the connecting tubes 206A-206D can be lined with a porous material. For example, in an embodiment, the connecting tubes 206A-206D can be made of a sintered metal or the like. In such an embodiment, use of the porous material may, for example, add acoustic absorption.

In an embodiment, the muffler 200 does not affect a discharge pressure drop of the compressor 12. As a result, reduction of a sound level of the compressor can be reduced with only limited impacts to an efficiency of the compressor 12 since the working fluid passes adjacent to the muffler 200, not directly through the muffler 200.

In an embodiment, the muffler 200 can be included in the upper portion 22A of the enclosure 22 of the compressor 12 at a time of manufacturing the enclosure 22. In an embodiment, the muffler 200 can be installed into the enclosure 22 of the compressor 12 at a time after manufacturing, including after the compressor 12 has been operated. That is, the muffler 200 can be retrofit into the compressor 12, according to an embodiment.

It will be appreciated that aspects of FIGS. 2-5, though described separately, can be combined in a single compressor, according to an embodiment.

Aspects:

It is noted that any one of aspects 1-11 can be combined with any one of aspects 12-22 and/or 23-25. Any one of aspects 12-22 can be combined with any one of aspects 23-25.

Aspect 1. A scroll compressor, comprising:

an enclosure including:

a compression mechanism that compresses a working fluid;

a discharge port through which a compressed working fluid is discharged;

a discharge plenum which receives the compressed working fluid from the discharge port; and a pulsation absorber disposed within the discharge plenum, the pulsation absorber dividing the discharge plenum into a plurality of volumes.

Aspect 2. The scroll compressor according to aspect 1, wherein the pulsation absorber is a porous material disposed perpendicular to a longitudinal axis of the discharge port, thereby dividing the discharge plenum into two chambers.

Aspect 3. The scroll compressor according to aspect 2, wherein the pulsation absorber is made of a sintered metal, a perforated sheet metal, a micro-perforated sheet metal, metallic fiber, or another pulsation-absorbing medium.

Aspect 4. The scroll compressor according to any one of aspects 1-3, wherein the pulsation absorber is disposed a distance from the discharge port that is based on absorption of pulsations in the working fluid across a particular frequency range.

Aspect 5. The scroll compressor according to any one of aspects 2-4, further comprising a tuning member disposed perpendicularly to the pulsation absorber.

Aspect 6. The scroll compressor according to aspect 5, wherein the tuning member is disposed on a side of the pulsation absorber that is relatively away from the discharge port.

Aspect 7. The scroll compressor according to any one of aspects 5-6, wherein the tuning member forms a plurality of pulsation chambers.

Aspect 8. The scroll compressor according to aspect 7, wherein the plurality of pulsation chambers are designed to attenuate selected frequencies, the plurality of pulsation chambers having different volumes.

Aspect 9. The scroll compressor according to any one of aspects 1-8, wherein the pulsation absorber includes a muffler assembly, the muffler assembly including a volume and a connecting tube.

Aspect 10. The scroll compressor according to aspect 9, wherein a longitudinal axis of the connecting tube is perpendicular to a longitudinal axis of the discharge port.

Aspect 11. The scroll compressor according to any one of claims 9-10, wherein the connecting tube is lined with a porous material.

Aspect 12. A heating, ventilation, and air conditioning (HVAC) system, comprising:

a compressor, a condenser, an expansion device, and an evaporator fluidly connected forming a heat transfer circuit, wherein the compressor is a scroll compressor, the scroll compressor including:

an enclosure including:

a compression mechanism that compresses a working fluid;

a discharge port through which a compressed working fluid is discharged;

a discharge plenum which receives the compressed working fluid from the discharge port; and a pulsation absorber disposed within the discharge plenum, the pulsation absorber dividing the discharge plenum into a plurality of volumes.

Aspect 13. The HVAC system according to aspect 12, wherein the pulsation absorber is a porous material disposed perpendicular to a longitudinal axis of the discharge port, thereby dividing the discharge plenum into two chambers.

Aspect 14. The HVAC system according to aspect 13, wherein the pulsation absorber is made of a sintered metal, a perforated sheet metal, or a micro-perforated sheet metal.

Aspect 15. The HVAC system according to any one of aspects 12-14, wherein the pulsation absorber is disposed a distance from the discharge port that is based on absorption of pulsations in the working fluid across a particular frequency range.

Aspect 16. The HVAC system according to any one of aspects 13-15, further comprising a tuning member disposed perpendicularly to the pulsation absorber.

Aspect 17. The HVAC system according to aspect 16, wherein the tuning member is disposed on a side of the pulsation absorber that is relatively away from the discharge port.

Aspect 18. The HVAC system according to any one of aspects 16-17, wherein the tuning member forms a plurality of pulsation chambers.

Aspect 19. The HVAC system according to aspect 18, wherein the plurality of pulsation chambers are designed to attenuate selected frequencies, the plurality of pulsation chambers having different volumes.

Aspect 20. The HVAC system according to any one of aspects 12-19, wherein the pulsation absorber includes a muffler assembly, the muffler assembly including a volume and a connecting tube.

Aspect 21. The HVAC system according to aspect 20, wherein a longitudinal axis of the connecting tube is perpendicular to a longitudinal axis of the discharge port.

Aspect 22. The HVAC system according to any one of claims 20-21, wherein the connecting tube is lined with a porous material.

Aspect 23. A method for attenuating pulsation in a scroll compressor, comprising:

directing a compressed working fluid from a compression mechanism of the scroll compressor through a discharge port into the discharge plenum; and directing the compressed working fluid into a plurality of volumes within the discharge plenum, the plurality of volumes being formed by a pulsation absorber disposed within the discharge plenum.

Aspect 24. The method according to aspect 23, wherein the dividing is performed at a time of manufacturing the scroll compressor.

Aspect 25. The method according to aspect 24, wherein the dividing is performed after a time of manufacturing the scroll compressor.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, indicate the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts, without departing from the scope of the present disclosure. The word "embodiment" as used within this specification may, but does not necessarily, refer to the same embodiment. This specification and the embodiments described are examples only. Other and further embodiments may be devised without departing from the basic scope thereof, with the true scope and spirit of the disclosure being indicated by the claims that follow.

What is claimed is:

1. A scroll compressor, comprising:

an enclosure including:

a compression mechanism that compresses a working fluid;

a discharge port through which a compressed working fluid is discharged;

a discharge plenum which receives the compressed working fluid from the discharge port; and a pulsation absorber disposed within the discharge plenum, the pulsation absorber dividing the discharge plenum into a plurality of volumes, the pulsation absorber extending across a diameter of the enclosure and contacting walls of the enclosure, and the entire pulsation absorber extending in a direction perpendicular to a longitudinal axis of the discharge port, wherein in a sectional view of the scroll compressor, the pulsation absorber includes a first end and a second end, the first end and the second end contact walls of the enclosure, and the entire pulsation absorber extends from the first end to the second end in the direction perpendicular to the longitudinal axis of the discharge port.

2. The scroll compressor according to claim 1, wherein the pulsation absorber is a porous material dividing the discharge plenum into two chambers.

3. The scroll compressor according to claim 2, wherein the pulsation absorber is made of a sintered metal, a perforated sheet metal, a micro-perforated sheet metal, metallic fiber, or another pulsation-absorbing medium.

4. The scroll compressor according to claim 2, wherein the pulsation absorber is disposed a distance from the discharge port that is based on absorption of pulsations in the compressed working fluid across a particular frequency range.

5. The scroll compressor according to claim 2, further comprising a tuning member disposed perpendicularly to the pulsation absorber.

6. The scroll compressor according to claim 5, wherein the tuning member is disposed on a side of the pulsation absorber that is relatively away from the discharge port.

7. The scroll compressor according to claim 5, wherein the tuning member forms a plurality of pulsation chambers.

8. The scroll compressor according to claim 7, wherein the plurality of pulsation chambers are designed to attenuate selected frequencies, the plurality of pulsation chambers having different volumes.

9. The scroll compressor according to claim 1, further comprising a muffler assembly, the muffler assembly including a shell having a volume and a connecting tube disposed between the shell and the discharge port, the connecting tube connecting the shell to the discharge port.

10. The scroll compressor according to claim 9, wherein a longitudinal axis of the connecting tube is perpendicular to the longitudinal axis of the discharge port.

11. The scroll compressor according to claim 9, wherein the connecting tube is lined with a porous material.

12. The scroll compressor according to claim 1, further comprising a plurality of muffler assemblies, each of the plurality of muffler assemblies including a shell having a volume and a connecting tube disposed between the shell and the discharge port, the connecting tube connecting the shell to the discharge port.

13. A heating, ventilation, and air conditioning (HVAC) system, comprising:

a compressor, a condenser, an expansion device, and an evaporator fluidly connected forming a heat transfer circuit, wherein the compressor is a scroll compressor, the scroll compressor including:

an enclosure including:

a compression mechanism that compresses a working fluid;

a discharge port through which a compressed working fluid is discharged;

a discharge plenum which receives the compressed working fluid from the discharge port; and a pulsation absorber disposed within the discharge plenum, the pulsation absorber dividing the discharge plenum into a plurality of volumes, the pulsation absorber extending across a diameter of the enclosure and contacting walls of the enclosure, and the entire pulsation absorber extending in a direction perpendicular to a longitudinal axis of the discharge port, wherein in a sectional view of the scroll compressor, the pulsation absorber includes a first end and a second end, the first end and the second end contact walls of the enclosure, and the entire pulsation absorber extends from the first end to the second end in the direction perpendicular to the longitudinal axis of the discharge port.

14. The HVAC system according to claim 13, wherein the pulsation absorber is a porous material dividing the discharge plenum into two chambers, and the pulsation absorber is made of a sintered metal, a perforated sheet metal, or a micro-perforated sheet metal.

15. The HVAC system according to claim 13, wherein the pulsation absorber is disposed a distance from the discharge port that is based on absorption of pulsations in the compressed working fluid across a particular frequency range.

16. The HVAC system according to claim 14, further comprising a tuning member disposed perpendicularly to the pulsation absorber, the tuning member disposed on a side of the pulsation absorber that is relatively away from the discharge port and forming a plurality of pulsation chambers, wherein the plurality of pulsation chambers are designed to attenuate selected frequencies, the plurality of pulsation chambers having different volumes.

17. The HVAC system according to claim 13, wherein the pulsation absorber includes a muffler assembly, the muffler assembly including a shell having a volume and a connecting tube disposed between the shell and the discharge port, the connecting tube connecting the shell to the discharge port, wherein a longitudinal axis of the connecting tube is perpendicular to the longitudinal axis of the discharge port, the connecting tube being lined with a porous material, and wherein the muffler assembly is a resonator, the shell having the volume is an elastic element of the resonator.

18. A method for attenuating pulsation in a scroll compressor, comprising:

directing a compressed working fluid from a compression mechanism of the scroll compressor through a discharge port into the discharge plenum; and directing the compressed working fluid into a plurality of volumes within the discharge plenum, the plurality of volumes being formed by a pulsation absorber disposed within the discharge plenum, the pulsation absorber extending across a diameter of the enclosure and contacting walls of the enclosure, and the entire pulsation absorber extending in a direction perpendicular to a longitudinal axis of the discharge port, wherein in a sectional view of the scroll compressor, the pulsation absorber includes a first end and a second end, the first end and the second end contact walls of the enclosure, and the entire pulsation absorber extends from the first end to the second end in the direction perpendicular to the longitudinal axis of the discharge port.

19. The method according to claim 18, further comprising:

dividing the discharge plenum into the plurality of volumes;

wherein the dividing is performed at a time of manufacturing the scroll compressor.

20. The method according to claim 18, further comprising:

dividing the discharge plenum into the plurality of volumes;

wherein the dividing is performed after a time of manufacturing the scroll compressor.

* * * * *